US010723138B2

(12) United States Patent
Lang et al.

(10) Patent No.: US 10,723,138 B2
(45) Date of Patent: Jul. 28, 2020

(54) PRINTING SYSTEMS

(71) Applicant: Hewlett-Packard Development Company, L.P., Spring, TX (US)

(72) Inventors: Tracy A. Lang, Corvallis, OR (US); Thomas A. Saksa, Corvallis, OR (US); Jay Shields, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/462,022

(22) PCT Filed: Mar. 23, 2017

(86) PCT No.: PCT/US2017/023752
§ 371 (c)(1),
(2) Date: May 17, 2019

(87) PCT Pub. No.: WO2018/174880
PCT Pub. Date: Sep. 27, 2018

(65) Prior Publication Data

US 2019/0299653 A1 Oct. 3, 2019

(51) Int. Cl.

| | |
|---|---|
| ***B41J 2/385*** | (2006.01) |
| ***B41J 2/14*** | (2006.01) |
| ***B41J 11/00*** | (2006.01) |

(52) U.S. Cl.
CPC ..... *B41J 2/385* (2013.01); *B41J 2/1433* (2013.01); *B41J 11/0015* (2013.01)

(58) Field of Classification Search
CPC . B41J 2/06; B41J 2/14233; B41J 2/161; B41J 2002/14491; B41J 2/1433; B41J 2/385; B41J 11/0015; B41J 2/085; B41J 2/14072; B41J 2/3351
See application file for complete search history.

(56) References Cited

U.S. PATENT DOCUMENTS

| | | | | |
|---|---|---|---|---|
| 5,866,284 | A | 2/1999 | Vincent | |
| 6,561,628 | B1 | 5/2003 | Camis et al. | |
| 7,387,352 | B2 | 6/2008 | Florence et al. | |
| 8,251,506 | B2 * | 8/2012 | Kato | B41J 11/007 347/104 |
| 8,714,731 | B2 | 5/2014 | Leung et al. | |
| 8,801,171 | B2 | 8/2014 | DiRubio et al. | |

(Continued)

OTHER PUBLICATIONS

International Search Report dated Dec. 7, 2017 for PCT/US2017/023752, Applicant Hewlett-Packard Development Company, L.P.

(Continued)

*Primary Examiner* — Jannelle M Lebron
(74) *Attorney, Agent, or Firm* — Thorpe North & Western LLP

(57) ABSTRACT

The present disclosure is drawn to printing systems. In one example, a printing system can include an electrode having a plurality of electrode protrusions associated therewith and a conductive plate. The electrode and conductive plate can be positioned with respect to one another to generate an electric field therebetween and to allow a media substrate to be positioned therebetween to be exposed to the electric field. Additionally, an inkjet print head can form a printed image on the media substrate after exposure to the electric field.

15 Claims, 5 Drawing Sheets

(56) References Cited

U.S. PATENT DOCUMENTS

| | | | | |
|---|---|---|---|---|
| 9,174,432 | B2 | 11/2015 | Liu et al. | |
| 9,376,582 | B1 | 6/2016 | Dannhauser et al. | |
| 2012/0013672 | A1 | 1/2012 | Holland et al. | |
| 2012/0212531 | A1* | 8/2012 | Yamada | B41J 2/14072 347/10 |
| 2014/0364548 | A1 | 12/2014 | Everhardus et al. | |
| 2015/0343798 | A1* | 12/2015 | Saksa | B41J 11/0015 347/21 |

OTHER PUBLICATIONS

Plasma Treatment Improves Print Durability on Nexans' Wire—Enercon Industries, http://www.enerconind.com/treating/library/customer-stories/plasma-treatment-improves-ink-durability-on-wire.aspx, Mar. 2, 2017.

* cited by examiner

PRINTING SYSTEMS

BACKGROUND

Inkjet printing has become a popular way of recording images on various media. Some of the reasons include low printer noise, variable content recording, capability of high speed recording, and multi-color recording. These advantages can be obtained at a relatively low price to consumers. As the popularity of inkjet printing increases, the types of use also increase, providing a demand for improved inkjet ink printing systems.

DETAILED DESCRIPTION

Figure 1A:
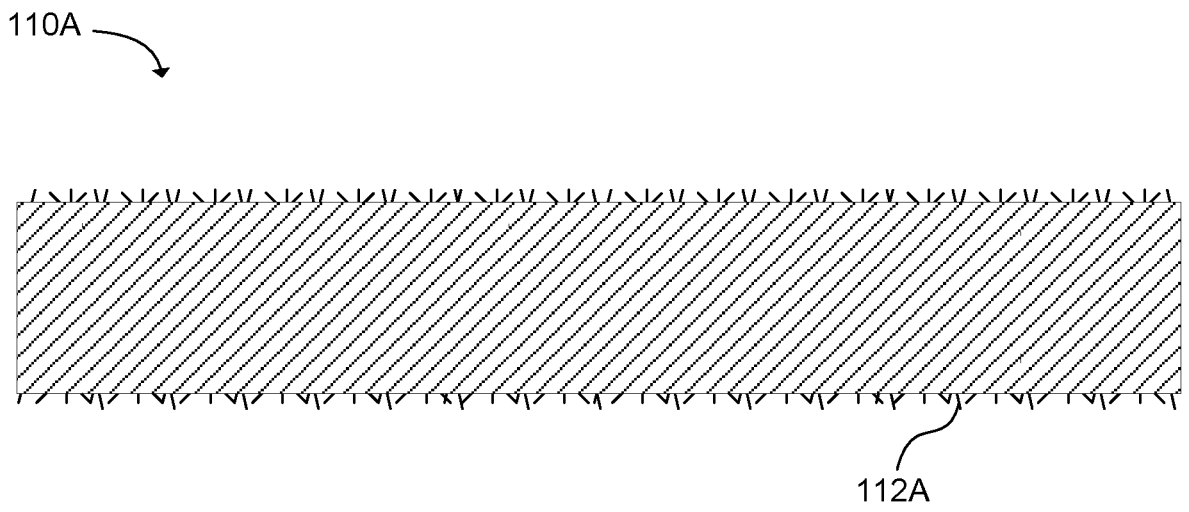
FIG. 1A illustrates a front view of an example electrode having a plurality of electrode protrusions, in accordance with examples of the present disclosure.

A challenge often encountered with inkjet printing is obtaining high color saturation and optical density of images printed with the ink. When the ink is printed on plain paper, the liquid vehicle can be absorbed into the paper. The colorant can thus be transported with the liquid vehicle into the paper. Because a portion of the colorant is absorbed below the surface of the paper, the printed image may appear washed out, having a low color saturation or optical density. Other problems encountered when printing inkjet inks on plain paper include strike through (e.g., the ink may be visible on the non-printed side of the paper), poor edge quality, mottling, and inter-color bleeding. Improving image quality can occur by reducing the negative visual impact of one or more of these problems.

Further, print quality of synthetic print media can also be problematic. Typically, synthetic print media can have a low surface energy, resulting in poor wettability of the media and ink coalescence, which can lead to poor print and image quality when printing with these types of media substrates. Thus, it can be advantageous to increase the surface energy of synthetic print media to improve the associated print and image quality.

The present disclosure is drawn to printing systems employing an electrode and a conductive plate to generate an electric field therebetween to expose at least a portion of a media substrate to the electric field before printing. The present disclosure also includes methods of forming printed images incorporating treatment of the media substrate with an electric field generated between an electrode and conductive plate, as well as printed articles made using such methods.

A printing system according to an example of the present disclosure can include an electrode having a plurality of electrode protrusions associated therewith and a conductive plate. The electrode and the conductive plate can be positioned with respect to one another to generate an electric field therebetween and to allow a media substrate to be positioned therebetween to be exposed to the electric field. The printing system can also include an inkjet print head to form a printed image on the media substrate after exposure to the electric field. Pre-treatment of the media substrate via exposure to an electric field generated between the electrode and the conductive plate can modify the surface of the media substrate so that the surface interacts with inkjet ink printed on the surface to improve print quality. In one example, pre-treatment of plain paper or synthetic print media with the electric field, even without the use of fixer present (e.g., a digitally printed fixer or an analog fixer coating, or ColorLok® paper), can provide a paper substrate that can meet or exceed the print quality achieved using paper with a fixer. For example, the print quality on a plain or synthetic paper, after pre-treatment with the electric field, can approach, match, or exceed the print quality provided using ColorLok® paper or paper that has a fixative solution applied before printing.

The material used to make the electrode is not particularly limited. In some examples, the electrode can be any suitable material that can be paired with a suitable conductive plate to generate an electric field at a voltage of from about 3000 volts to about 30,000 volts that will adequately increase the surface energy of the print media to achieve a desired print quality and/or image quality. Further, the electrode can be any suitable material that can generate an electric field using direct or alternating current. Where alternating current is used, the electrode can be any suitable material that can generate an electric field within the voltage requirements and at a frequency of from about 5000 hertz (Hz) to about 30,000 Hz.

Within these parameters, and at a suitable relative positioning, a variety of materials can be used for the electrode and conductive plate to generate an adequate electric field and any such suitable material is considered within the scope of the present disclosure. In some non-limiting examples, the electrode can be made with carbon, carbon fiber, graphite, copper, titanium, brass, silver, platinum, palladium, oxides thereof, alloys thereof, or combinations thereof. Further, the electrodes can be electrode cords, electrode bars, electrode plates, or the like. In some examples, where the electrode is an electrode cord, it can be a twisted electrode cord. Thus, a variety of suitable electrode configurations can be used.

It is further noted that the electrode can have a plurality of electrode protrusions associated therewith. An electrode with a plurality of electrode protrusions can further expand the choices of possible electrode and conductive plate materials that can be suitable for use in the present printing systems. For the sake of brevity, and without limitation, this design will be described with respect to a carbon fiber electrode. A carbon fiber electrode can be made of a plurality of interwoven or entangled carbon fiber strands. The ends of the carbon fiber strands can typically be fractured or otherwise terminate at very fine or sharp tips. In some examples, the tips can have a diameter on the picometer scale (i.e. approaching the thickness of a single atom). Due to the small diameter or radius of curvature of the tips, the electric field can be very strong at these points. This can allow a strong electric field to be generated at relatively low voltages and frequencies that is still adequate to increase the surface energy of a print medium. It is emphasized that an electrode with a plurality of electrode protrusions is not limited to carbon fiber electrodes. Such electrodes can be made from a variety of other materials, such as those listed above as non-limiting examples. In some specific examples, the electrode protrusions can have a tip diameter ranging from about 0.1 nm to about 10 μm. In some additional examples, the electrode can include a minimum of 10, 100, 500, 1000, or 5000 electrode protrusions for an electrode spanning the width of a print medium having a width of from about 1 inch to about 60 inches, or from about 3 inches to about 40 inches, or from about 4 inches to about 9 inches.

Figure 1B:
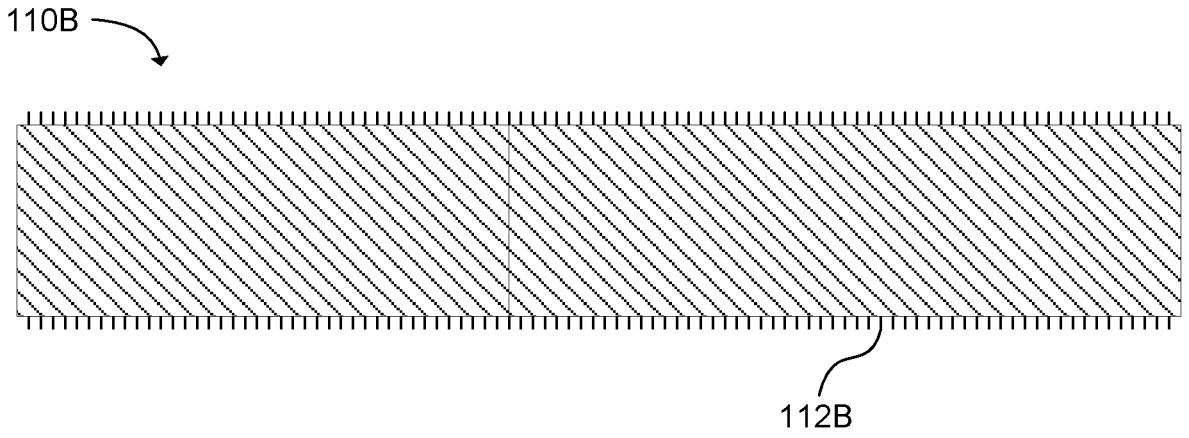
FIG. 1B illustrates a front view of another example electrode having a plurality of electrode protrusions, in accordance with examples of the present disclosure.

Representative examples of electrodes having a plurality of electrode protrusions are illustrated in FIG. 1A and FIG. 1B. FIG. 1A represents an example of an electrode 110A having a plurality of electrode protrusions 112A associated therewith that are non-uniform and multidirectional. This can be a typical orientation of electrode protrusions when using woven or intertangled electrode fibers, a twisted electrode cord, or the like. In some other examples, as illustrated in FIG. 1B, an electrode 110B can include a plurality of electrode protrusions 112B that extend from a surface of the electrode in a substantially uniform and parallel manner. This can be a typical orientation of an electrode bar having electrode protrusions deposited thereon, grown therefrom, drawn therefrom, or the like. It is further noted that the electrode protrusions need not extend from all sides of the electrode. Depending on the type of electrode used, and the specific fabrication process for the electrode, the plurality of electrode protrusions can extend from a single side or surface or any suitable combination of sides or surfaces of the electrode. It is also noted that FIG. 1A and FIG. 1B are not drawn to scale, but are merely used as illustrative examples for discussion purposes only.

Like the electrode, the conductive plate can also be made of a variety of materials. Again, the specific requirements for material selection for the conductive plate are generally the same as those described above with respect to the electrode. The conductive plate can be any suitable material that can be paired with an electrode to facilitate generation of an adequate electric field at the voltages and frequencies described above to sufficiently increase the surface energy of a print substrate. Non-limiting examples of materials suitable for use with the conductive plate can include steel, copper, aluminum, carbon, silver, gold, brass, nickel, molybdenum, zinc, lithium, iron, oxides thereof, alloys thereof, or combinations thereof.

Figure 2A:
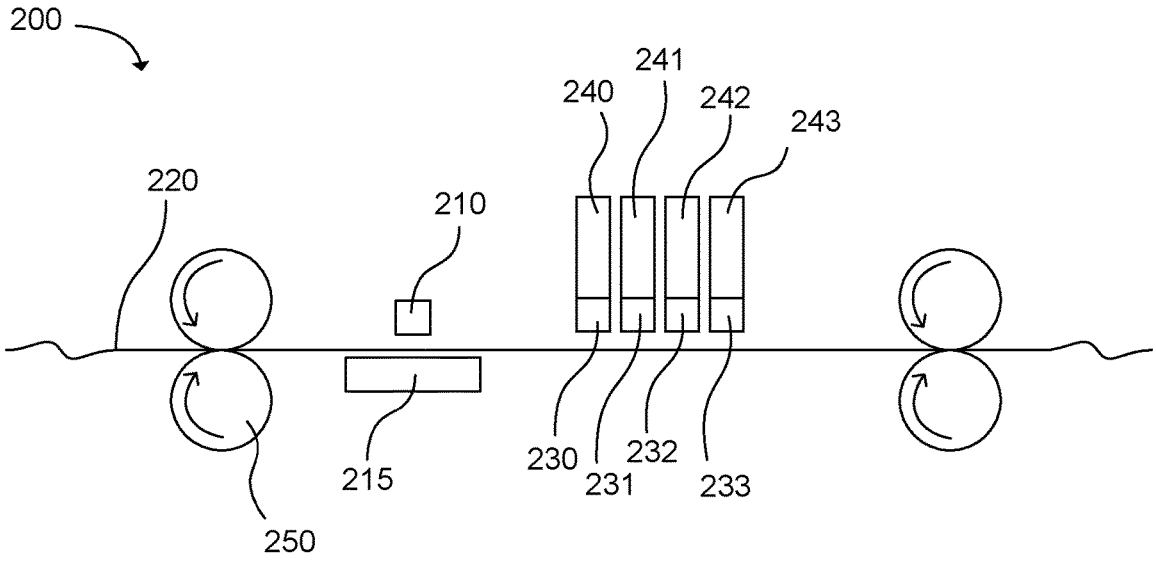
FIG. 2A is a schematic side view of an example printing system in accordance with examples of the present disclosure.

With this description in mind, FIG. 2A shows a schematic side view of a printing system 200 in accordance with examples of the present disclosure. The printing system can include an electrode 210 and a conductive plate 215 positioned with respect to one another to generate an electric field therebetween and to allow a media substrate 220 to be positioned therebetween to be exposed to the electric field. It is noted that the electrode and the conductive plate are depicted in this schematic as having different lengths, but this is not necessary. The electrode and the conductive plate can have the same length or different lengths as desired. The printing system can also include inkjet print heads 230, 231, 232, 233. The inkjet print heads can form a printed image on the media substrate after exposure to the electric field. The inkjet print heads can be used to print different colors, such as cyan, magenta, yellow, black, blue, green, red, purple, orange, gray, etc., or a clear overcoat. In certain examples, the colors may be cyan, magenta, and yellow (three colors); or cyan, magenta, yellow, and black (four colors). The inkjet print heads may also be in fluid communication with ink reservoirs 240, 241, 242, 243, and may carry the inks. The media substrate, as shown, can be conveyed past the electrode, conductive plate, and the inkjet print heads by conveyors 250.

Figure 2B:
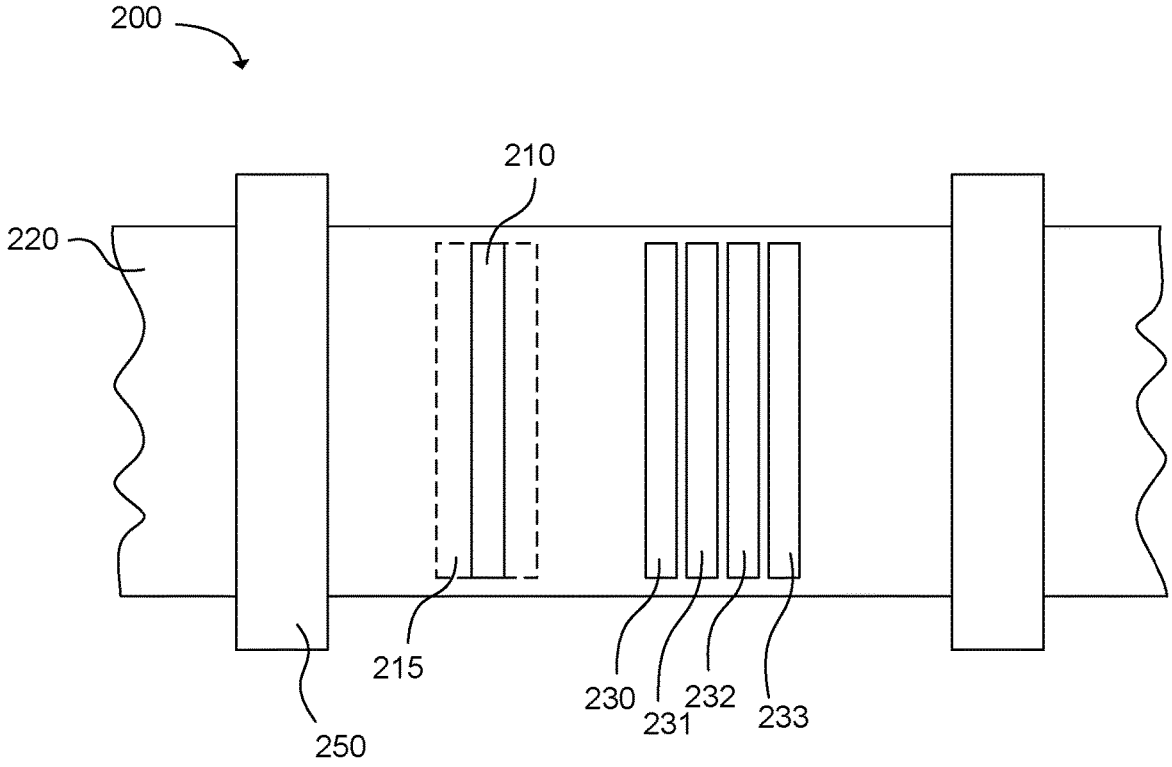
FIG. 2B is a schematic top view of an example printing system in accordance with examples of the present disclosure.

FIG. 2B shows a schematic top view of the printing system of FIG. 2A. As shown in FIG. 2B, in some examples, the electrode 210, conductive plate 215, and inkjet print heads 230, 231, 232, 233 can have nearly the same width as the media substrate 220. In certain examples, the electrode, the conductive plate, or both can be 75% or more as wide as the media substrate, or 90% or more as wide as the media substrate. In further examples, the electrode, the conductive plate, or both can be as wide as the media substrate or wider.

In some examples, the electrode 210, the conductive plate 215, and/or the inkjet print heads 230, 231, 232, 233 can be held stationary while the media substrate is conveyed past. Thus, in one example, the electric field generated between the electrode and the conductive plate can treat the entire width of the media substrate or a portion of the media substrate as wide as the electrode and/or the conductive plate. After the media substrate is treated, the inkjet print heads can print ink onto the media substrate as the media substrate is conveyed past.

In other examples, the electrode 210, the conductive plate 215, and/or the inkjet printheads 230, 231, 232, 233 can be movable, such as on a carriage, and traverse the media substrate. In other words, in the example shown, these features are static or fixed, but one or more can alternatively be movable.

As previously discussed, the treatment with the electric field can effectively modify the surface of the media substrate very quickly so that distance between the inkjet print heads and the combination of the electrode and conductive plate is not particularly limiting, e.g., many different distances can be used. Additionally, the treatment can retain its effect on the surface of the media substrate for an extended time, such as more than one day, one week, one month, or more than one year, depending on the treatment and the media substrate being employed. Thus, typically no particular proximity of distance or time between the electric field and the inkjet print heads or associated printing will impact the result. However, some types of media substrates, such as some types of synthetic media substrates, can revert back to original surface energy within a few days or weeks. Thus, in some examples, it can be advantageous to print on the media substrate within a reasonable period of time after surface treatment of the media substrate. As such, in some examples, the electrode and conductive plate can be positioned directly adjacent to the inkjet print heads. In other examples, the electrode and conductive plate can be positioned any convenient distance from the inkjet print heads, such as from 1 mm to 10 meters away from the inkjet print heads. This can provide advantages over printing systems that apply a liquid fixer solution to a media substrate before printing, because such systems often employ a drying zone between the fixer application and the print heads. Such systems can use a drying oven or a long distance between the fixer application and the print heads to allow water and/or other solvents in the fixer solution to evaporate. In some cases, such printing systems run at a slower printing speed to give the fixer solution more time to dry. In contrast, the treatment used in the present technology can be a dry treatment. Therefore, in many examples, no liquid is added to the media substrate and no drying zone is used between the inkjet print heads the combination of the electrode and the conductive plate.

Figure 3:
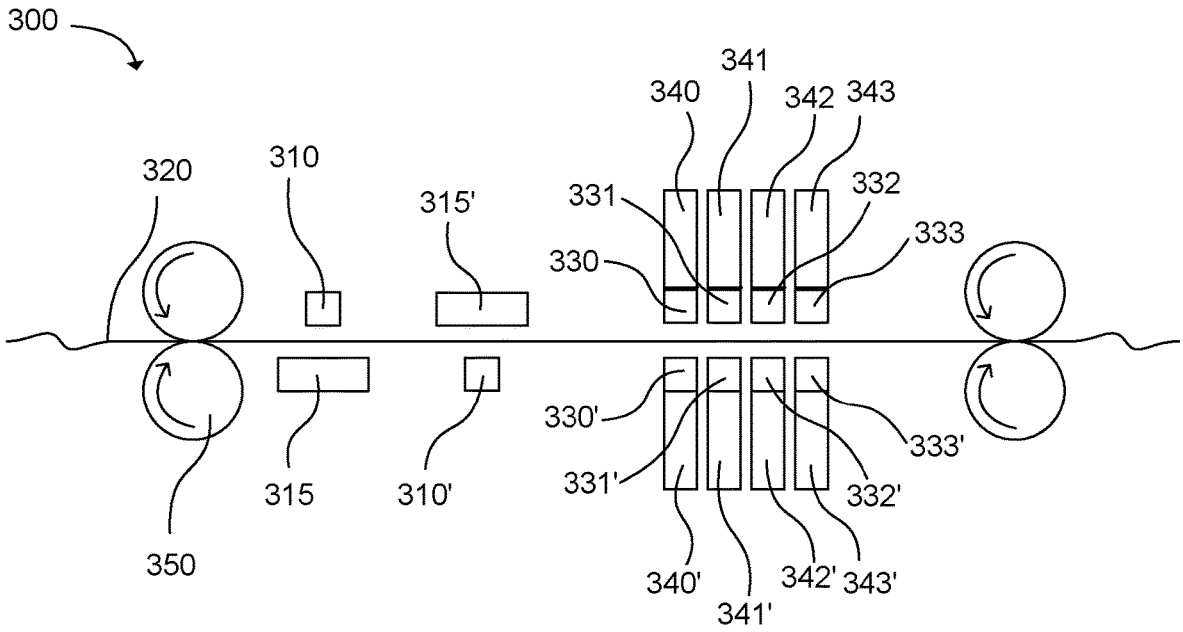
FIG. 3 is a schematic side view of an example printing system in accordance with examples of the present disclosure.

It should be noted that the example shown in FIGS. 2A and 2B is only a single example of the presently disclosed technology. In other examples, printing systems according to the present disclosure can have a variety of different configurations. FIG. 3 shows another example of a printing system 300 that includes a first electrode 310, a first conductive plate 315, and first set of inkjet print heads 330, 331, 332, 333 in fluid communication with ink reservoirs 340, 341, 342, 343. These components are positioned to pretreat and print on a first surface of the media substrate 320. A second electrode 310', second conductive plate 315', and second set of inkjet print heads 330', 331', 332', 333' in fluid communication with ink reservoirs 340', 341', 342', 343' are oppositely oriented to pretreat and print the opposite surface of the media substrate. The media substrate is conveyed between the two sets of electrodes, conductive plates, and inkjet print heads by conveyors 350. Thus, the system can pretreat and print on both surfaces of the media substrate simultaneously. However, it is noted that in some examples two sets of electrodes and conductive plates are not necessary to pretreat both sides of the print media.

In additional examples, the electrode, the conductive plate, and/or the inkjet print head can be movable with respect to the media substrate. For example, in a web fed printing system the electrode, the conductive plate, and/or inkjet print head can move in a direction perpendicular to the movement direction of the media web. In another example, the printing system can be sheet fed. A media substrate sheet can be fed by conveyors past the electrode, the conductive plate, and inkjet print head, while the electrode, the conductive plate, and/or inkjet print head can move in a direction perpendicular to the movement direction of the media sheet. In a further example, the printing system can have a static printing bed on which a media substrate sheet is placed. The electrode, the conductive plate, and/or the inkjet print head can move in two dimensions (i.e., the x-axis and y-axis directions) over the media substrate sheet to pretreat and/or print on the media substrate sheet.

In some specific examples, the conductive plate can have a fixed position and the electrode can move relative to the conductive plate to generate the electric field between the electrode and the conductive plate. In other examples, the electrode can have a fixed position and the conductive plate can move relative to the electrode to generate the electric field between the electrode and the conductive plate. In yet other examples, both the electrode and the conductive plate can be movable, either in concert or relative to one another.

Figure 4:
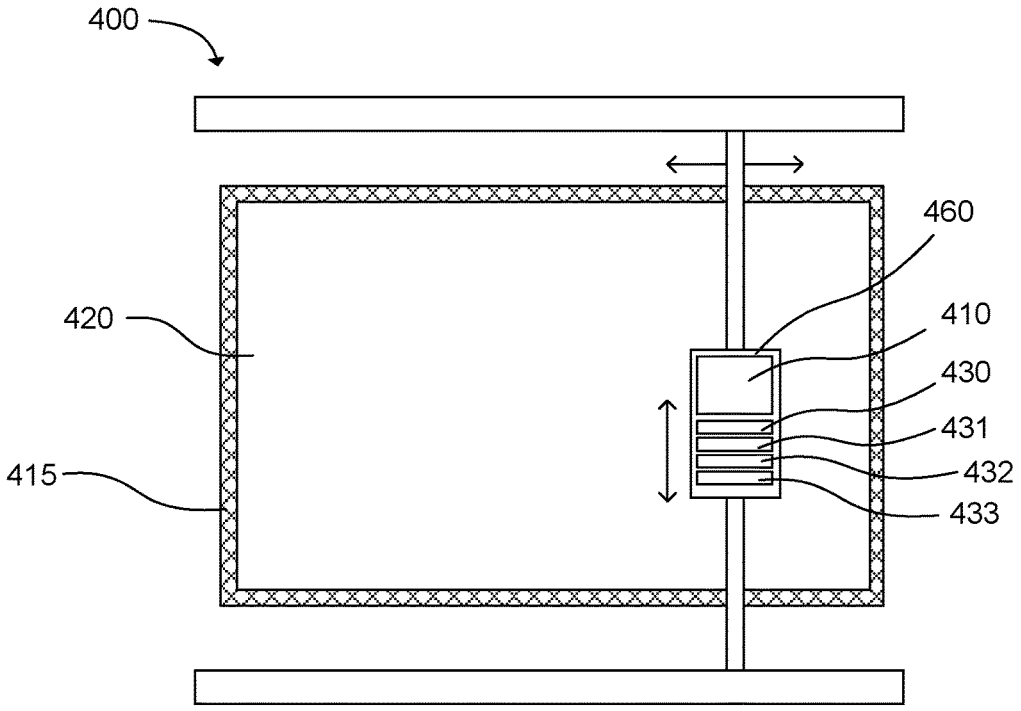
FIG. 4 is a schematic top view of an example printing system in accordance with examples of the present disclosure.

FIG. 4 shows an example of a printing system 400 including a stationary media substrate sheet 420. In this system, the electrode 410 and inkjet print heads 430, 431, 432, 433 are located together on a carriage 460. The conductive plate 415 is positioned on an opposite side of the media substrate sheet so as the generate an electric field across the media substrate sheet to increase the surface energy thereof. The carriage is moveable in the x-axis and y-axis directions so that the electrode can pretreat portions of the media substrate sheet, after which the inkjet print heads can print on the pretreated portions. Further, in one example, the media substrate may also or alternatively be movable. For example, the carriage may move in the y-axis as shown while the media substrate is moved along the x-axis.

Figure 5:
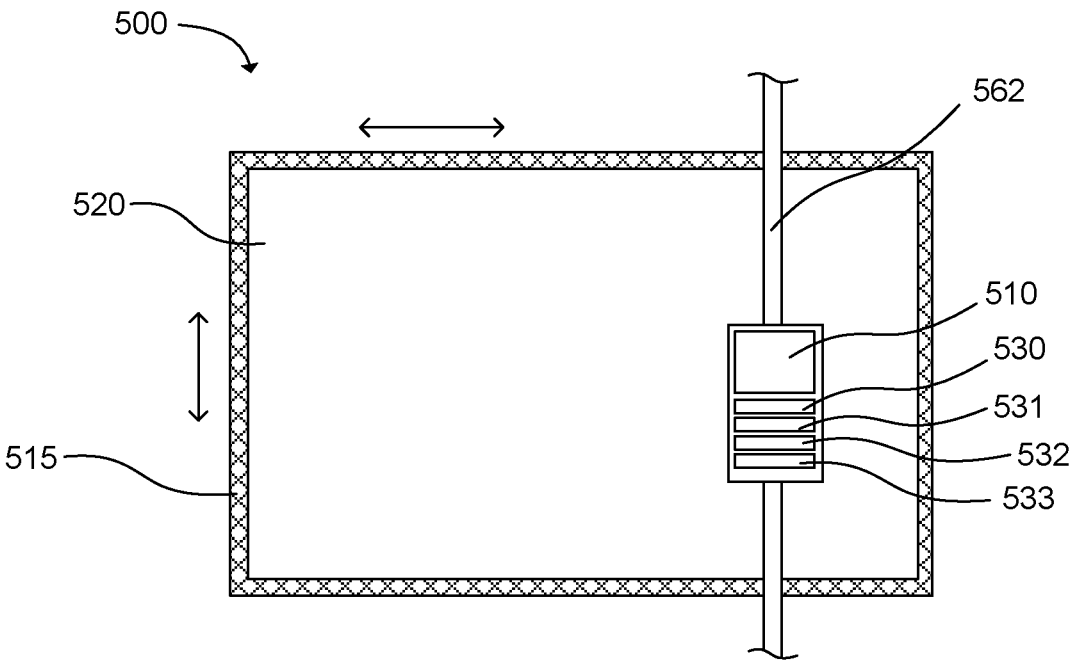
FIG. 5 is a schematic top view of an example printing system in accordance with examples of the present disclosure.

Similarly, FIG. 5 shows an example of a printing system 500 including a stationary electrode 510 and inkjet print heads 530, 531, 532, 533 attached to a support structure 562. A media substrate 520 can be positioned on the conductive plate 515 so as the generate an electric field across the media substrate sheet to increase the surface energy thereof. The conductive plate is moveable relative to the electrode and inkjet print heads in the x-axis and y-axis directions so that the electrode can pretreat portions of the media substrate sheet, after which the inkjet print heads can print on the pretreated portions.

As mentioned above, the printing systems described herein can include an inkjet print head. In some examples, a printing system can include a single inkjet print head. The inkjet print head can be in fluid communication with a reservoir of black ink or a colored ink. In other examples, the printing system can include multiple inkjet print heads. For example, the printing system can include an inkjet print head for several different colors, such as cyan, magenta, yellow, and black. In further examples, other colors of ink or clear overcoat material can be included.

As used herein, "inkjetting" or "jetting" refers to ejecting compositions from jetting architecture, such as inkjet architecture. Inkjet architecture can include thermal, piezo, or continuous inkjet architecture. A thermal inkjet print head can include a resistor that is heated by electric current. Inkjet ink can enter a firing chamber and the resistor can heat the ink sufficiently to form a bubble in the ink. The expansion of the bubble can cause a drop of ink to be ejected from a nozzle connected to the firing chamber. Piezo inkjet print heads are similar, except that instead of a thermal resistor, a piezoelectric element is used to mechanically force a drop of ink out of a nozzle. In a continuous inkjet printing system, a continuous stream of ink droplets is formed and some of the droplets can be selectively deflected by an electrostatic field onto the media substrate. The remaining droplets may be recirculated through the system. Inkjet print heads can be configured to print varying drop sizes such as less than 10 picoliters, less than 20 picoliters, less than 30 picoliters, less than 40 picoliters, less than 50 picoliters, etc.

In some cases, the ink used in the printing systems described herein can be a water-based inkjet ink or a solvent-based inkjet ink. Inkjet inks generally include a colorant dispersed or dissolved in an ink vehicle. As used herein, "liquid vehicle" or "ink vehicle" refers to the liquid fluid in which a colorant is placed to form an ink. A wide variety of ink vehicles may be used with the methods of the present disclosure. Such ink vehicles may include a mixture of a variety of different agents, including, surfactants, solvents, co-solvents, anti-kogation agents, buffers, biocides, sequestering agents, viscosity modifiers, surface-active agents, water, etc.

Generally the colorant discussed herein can include a pigment and/or dye. As used herein, "dye" refers to compounds or molecules that impart color to an ink vehicle. As such, dye includes molecules and compounds that absorb electromagnetic radiation or certain wavelengths thereof. For example, dyes include those that fluoresce and those that absorb certain wavelengths of visible light. In most instances, dyes are water soluble. However, in some examples, the dye can be water insoluble and dispersed in an aqueous medium. Furthermore, as used herein, "pigment" generally includes pigment colorants, magnetic particles, aluminas, silicas, and/or other ceramics, organo-metallics or other opaque particles. In one example, the colorant can be a pigment. In a further example, the colorant can be an anionic pigment material that can interact with cationic species, acid groups, and/or oxygen containing groups at the surface of the media substrate that has been treated with the electrical field as described herein. For instance, the anionic pigment material can include an anionic dispersant (e.g. molecule, oligomer, polymer) that is adsorbed to or covalently bonded to the pigment. In some specific examples, the anionic dispersant can include carboxylate or phosphonate functionalities.

In certain examples, the colorant can be a pigment having a dispersing group covalently bonded to surfaces of the pigment. The dispersing groups can be, for example, small groups, oligomeric groups, polymeric groups, or combinations thereof. In other examples, the pigment can be dispersed with a separate dispersant. Suitable pigments include, but are not limited to, the following pigments available from BASF: Paliogen® Orange, Heliogen® Blue L 6901F, Heliogen® Blue NBD 7010, Heliogen® Blue K 7090, Heliogen® Blue L 7101F, Paliogen® Blue L 6470, Heliogen® Green K 8683, and Heliogen® Green L 9140. The following black pigments are available from Cabot: Monarch® 1400, Monarch® 1300, Monarch® 1100, Monarch® 1000, Monarch® 900, Monarch® 880, Monarch® 800, and Monarch® 700. The following pigments are available from CIBA: Chromophtal® Yellow 3G, Chromophtal® Yellow GR, Chromophtal® Yellow 8G, Igrazin® Yellow 5GT, Igrantee Rubine 4BL, Monastral® Magenta, Monastral® Scarlet, Monastral® Violet R, Monastral® Red B, and Monastral® Violet Maroon B. The following pigments are available from Degussa: Printex® U, Printex® V, Printex® 140U, Printex® 140V, Color Black FW 200, Color Black FW 2, Color Black FW 2V, Color Black FW 1, Color Black FW 18, Color Black S 160, Color Black S 170, Special Black 6, Special Black 5, Special Black 4A, and Special Black 4. The following pigment is available from DuPont: Tipure® R-101. The following pigments are available from Heubach: Dalamar® Yellow YT-858-D and Heucophthal Blue G XBT-583D. The following pigments are available from Clariant: Permanent Yellow GR, Permanent Yellow G, Permanent Yellow DHG, Permanent Yellow NCG-71, Permanent Yellow GG, Hansa Yellow RA, Hansa Brilliant Yellow 5GX-02, Hansa Yellow-X, Novoperm® Yellow HR, Novoperm® Yellow FGL, Hansa Brilliant Yellow 10GX, Permanent Yellow G3R-01, Hostaperm® Yellow H4G, Hostaperm® Yellow H3G, Hostaperm® Orange GR, Hostaperm® Scarlet GO, and Permanent Rubine F6B. The following pigments are available from Mobay: Quindo® Magenta, Indofast® Brilliant Scarlet, Quindo® Red R6700, Quindo® Red R6713, and Indofast® Violet. The following pigments are available from Sun Chemical: L74-1357 Yellow, L75-1331 Yellow, and L75-2577 Yellow. The following pigments are available from Columbian: Raven® 7000, Raven® 5750, Raven® 5250, Raven® 5000, and Raven® 3500. The following pigment is available from Sun Chemical: LHD9303 Black. Any other pigment and/or dye can be used that is useful in modifying the color of the ink. Additionally, the colorant can include a white pigment such as titanium dioxide, or other inorganic pigments such as zinc oxide and iron oxide.

In further examples, the ink can include a binder. In some examples, the binder can be a latex polymer. In further examples, the binder can include polymers, copolymers, or combinations thereof. The polymers and copolymers can be formed of styrene, acrylic acid, methacrylic acid, methyl methacrylate, butyl acrylate, divinylbenzene, or combinations thereof. In another example, the binder can be a polyurethane binder.

In some cases the binder can be curable. That is, the binder can be further polymerized or cross-linked after the ink is printed onto the media substrate. In one such example, the binder can include a polymerizable polyurethane. The ink used in the printing systems described herein can also include monomers that can be polymerized by exposure to radicals or other species generated by the electric field as described herein. In some examples, such polymerizable monomers can be used in addition to a polymerizable polyurethane. In other examples, the ink can include polymerizable monomers without a polymerizable polyurethane.

In some examples, the ink can further be devoid or substantially devoid of photoinitiators. Eliminating the photoinitiator from the ink can provide advantages such as making the ink more stable, increasing the shelf-life of the ink, and so on. Inks that contain curable components and photoinitiators can often undergo premature polymerization if exposed to UV light. Additionally, many photoinitiators are difficult to disperse or dissolve in aqueous ink vehicles. As such, the present technology allows for the use of curable ink without a photoinitiator. Therefore, these problems can be avoided.

The ink used in the printing systems described herein can also include a liquid vehicle. In some examples, liquid vehicle formulations that can be used in the ink can include water and one or more co-solvents. The co-solvents can be present in total at from 1 wt % to 50 wt %, depending on the jetting architecture. Further, one or more non-ionic, cationic, and/or anionic surfactants can be present, ranging from 0.01 wt % to 20 wt % (if present). In one example, the surfactant can be present in an amount from 0.1 wt % to 20 wt %. The liquid vehicle can also include dispersants in an amount from 0.1 wt % to 20 wt %. The balance of the formulation can be purified water, or other vehicle components such as biocides, viscosity modifiers, materials for pH adjustment, sequestering agents, preservatives, and the like. In one example, the liquid vehicle can be more than 50 wt % water.

In further examples, the liquid vehicle can be a non-aqueous, solvent-based vehicle. In one example, the liquid vehicle can include ethanol and additional co-solvents. Classes of co-solvents that can be used can include organic co-solvents including aliphatic alcohols, aromatic alcohols, diols, glycol ethers, polyglycol ethers, caprolactams, formamides, acetamides, and long chain alcohols. Examples of such compounds include primary aliphatic alcohols, secondary aliphatic alcohols, 1,2-alcohols, 1,3-alcohols, 1,5-alcohols, ethylene glycol alkyl ethers, propylene glycol alkyl ethers, higher homologs ($C_6$-$C_{12}$) of polyethylene glycol alkyl ethers, N-alkyl caprolactams, unsubstituted caprolactams, both substituted and unsubstituted formamides, both substituted and unsubstituted acetamides, and the like. Specific examples of solvents that can be used include, but are not limited to, 2-pyrrolidinone, N-methylpyrrolidone, 2-hydroxyethyl-2-pyrrolidone, 2-methyl-1,3-propanediol, tetraethylene glycol, 1,6-hexanediol, 1,5-hexanediol, and/or 1,5-pentanediol.

Surfactants that can be included in the ink can include alkyl polyethylene oxides, alkyl phenyl polyethylene oxides, polyethylene oxide block copolymers, acetylenic polyethylene oxides, polyethylene oxide (di)esters, polyethylene oxide amines, protonated polyethylene oxide amines, protonated polyethylene oxide amides, dimethicone copolyols, substituted amine oxides, and the like. Suitable surfactants can include, but are not limited to, liponic esters such as Tergitol™ 15-S-12, Tergitol™ 15-S-7 available from Dow Chemical Company, LEG-1 and LEG-7; Triton™ X-100, Triton™ X-405 available from Dow Chemical Company; LEG-1, and sodium dodecylsulfate.

Various other additives may be employed to enhance the properties of the ink composition for specific applications. Examples of these additives are those added to inhibit the growth of harmful microorganisms. These additives may be biocides, fungicides, and other microbial agents, which are routinely used in ink formulations. Examples of suitable microbial agents include, but are not limited to, NUOSEPT® (Nudex, Inc.), UCARCIDE™ (Union carbide Corp.), VANCIDE® (R.T. Vanderbilt Co.), PROXEL® (ICI America), ACTICIDE® (Thor Specialties Inc.) and combinations thereof. Sequestering agents such as EDTA (ethylenediaminetetraaceticacid) may be included to eliminate the deleterious effects of heavy metal impurities. From 0.001% to 2.0% by weight, for example, can be used. Viscosity modifiers may also be present, as well as other additives known to those skilled in the art to modify properties of the ink as desired. Such additives can be present at from 0.01% to 20% by weight.

In some examples, the inkjet ink can include ingredients in the amounts listed in Table 1:

TABLE 1

| Component | Weight Percent |
|---|---|
| Binder | 0.5-10% |
| Biocide | 0-5% |
| Surfactant | 0-10% |
| Anti-kogation agent | 0-5% |
| Colorant | 0.5-10% |
| Organic Co-solvent | 0.1-50% |
| Water* | Balance |

*Note that by "balance," what is meant is that water is used to achieve 100 wt %. Other ingredients other than the ones shown in Table 1 may be present, and water is used to arrive at 100 wt %, regardless of what other ingredients are present.

It is also noted that the term "ink," as used herein, can also include and encompass primers, pre-treatment fluids, activators, post-treatment fluids, or the like, unless otherwise specified. For example, in some cases, ink can refer only to an inkjet ink and can exclude primers, pre-treatment fluids, activators, post-treatment fluids, and the like. In yet other examples, ink can refer to inkjet inks, primers, pre-treatment fluids, activators, post-treatment fluids, the like, or combinations thereof.

The media substrate used in the printing system can be any of a wide variety of media substrates. Because the printing system includes the electrode and conductive plate to generate and electric field to pre-treat the media substrate before printing, the media substrate may or may not include fixer or other special ingredients to make the media substrate more compatible with inkjet inks. In one example, the media substrate can be substantially devoid of fixer. The treatment with the electric field can also be used on paper specially manufactured for inkjet printing. The treatment can potentially further improve the print quality using such paper. In various further examples, the media substrate can be plain paper, photo paper, glossy paper, offset paper, coated paper, coated offset paper, textile, synthetic print media, or combinations thereof.

Figure 6:
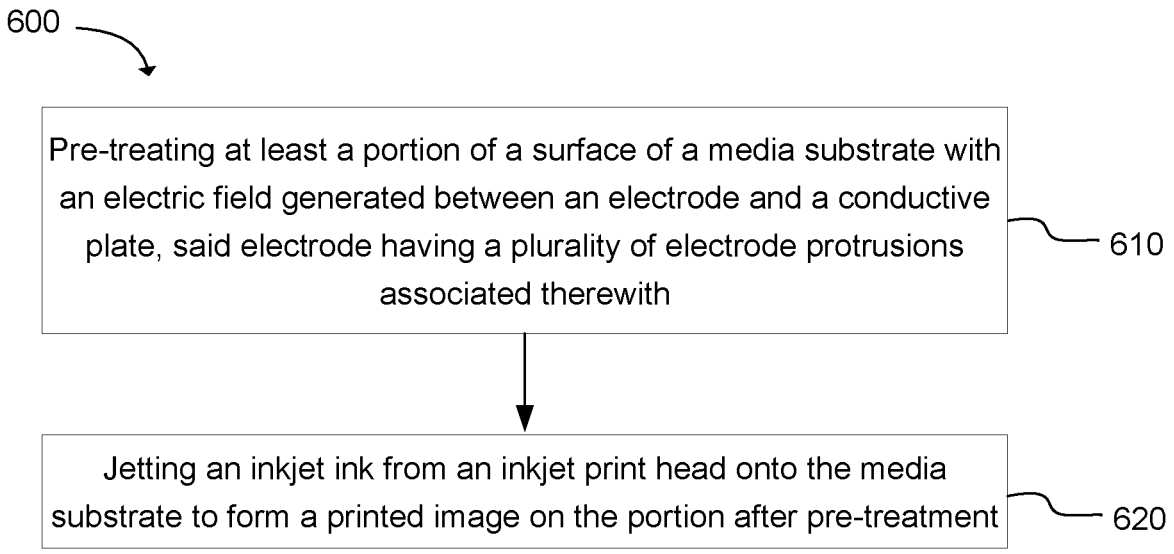
FIG. 6 is a flowchart illustrating an example method of forming a printed image on a media substrate in accordance with examples of the present disclosure.

The present disclosure also includes methods of forming a printed image on a media substrate. FIG. 6 shows one example of a method 600 of forming a printed image on a media substrate. The method includes pre-treating 610 a portion of a surface of the media substrate with an electric field generated between an electrode and a conductive plate, said electrode having a plurality of protrusions associated therewith; and jetting 620 an inkjet ink from an inkjet print head onto the media substrate to form a printed image on the portion. This can occur after pre-treating in one example.

In some examples, the electric field can be applied at a voltage of from about 3000 volts to about 30,000 volts. It is noted that voltages above 30,000 volts can also be used, so long as measures are taken to prevent or minimize arcing and/or deterioration of the electrode. In other examples, the electric field can be applied at a voltage of from about 10,000 volts to about 28,000 volts. In yet other examples, the electric field can be applied at a voltage of from about 20,000 volts to about 26,000 volts.

Further, as described above, the electric field can be applied using either direct current or alternating current. In some specific examples, the electric field can be generated via alternating current. In such examples, the alternating current can typically have a frequency of from about 5000 hertz (Hz) to about 30,000 Hz. In other examples, the alternating current can typically have a frequency of from about 10,000 Hz to about 28,000 Hz. In yet other examples, the alternating current can have a frequency of from about 20,000 Hz to about 26,000 Hz.

The adequacy of the electric field can also be related to the relative positioning of the electrode with respect to the conductive plate. Typically, the electrode and the conductive plate can be positioned at a distance from one another of from about 0.5 millimeters (mm) to about 20 mm. In yet other examples, the electrode and the conductive plate can be positioned at a distance from one another of from about 1 mm to about 5 mm or 10 mm.

In further examples, the pre-treatment with the electric field can be performed for a time period of 0.1 second to 60 seconds. In more specific examples, the time period can be 0.2 second to 45 seconds or 0.5 second to 30 seconds. As used herein, the time period of the treatment with an electric field refers to the amount of time that a treated portion of the media substrate is exposed to the electric field. In the case of a web-fed printing system, the media substrate can constantly move past through the electric field. Thus, the time period of the treatment can be the time required for a point on the media substrate to travel across the length of the electric field. In examples where the printing system includes an electrode or conductive plate that can move relative to the print media, such as on a carriage, the carriage can move at an appropriate speed so that each portion of the media substrate is pre-treated for the appropriate time period.

Generally, longer pre-treatment time periods can provide better printing results, as signified by higher optical density and color saturation. However, in some examples a maximum effect can be reached after a certain time period. This time period can be from 0.1 second to 60 seconds or any of the other time periods described above. In further examples, the distance of the electrode from the conductive can affect the time period required to reach the maximum pre-treatment effect. At greater distances, a longer time period may be required.

Additionally, longer post-treatment periods can provide better durability of curable ink. In further examples, the distance of the electrode from the conductive plate can affect the time period required to reach a given level of durability. At greater distances, a longer time period may be required.

Figure 7:
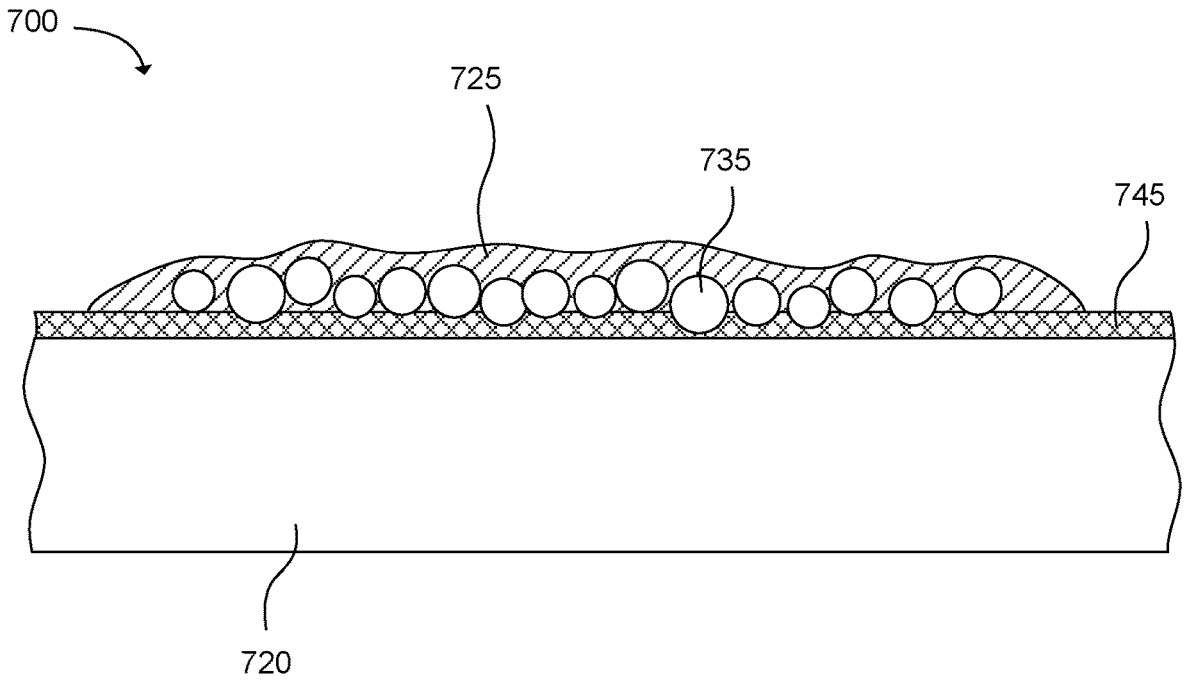
FIG. 7 is a schematic cross-sectional side view of an example printed article in accordance with examples of the present disclosure.

The present disclosure also includes printed articles made using the systems and methods described herein. FIG. 7 shows one example of a printed article 700. The printed article includes a media substrate 720. The media substrate includes a surface 745 that has been modified by exposure to an electric field generated between an electrode and a conductive plate before printing. The electrode can have a plurality of electrode protrusions associated therewith. The media substrate can be devoid of or substantially devoid of a printed fixer. A digitally printed image is formed on the modified surface of the media substrate such that pigment particles 735 in the digitally printed image are in contact with the modified surface of the media substrate. In some examples, the printed image can include an inkjet ink that has been cured by exposure to electromagnetic radiation. For example, the printed image can include pigment particles in contact with the surface of the media substrate and a cured binder 725 disposed over and throughout the pigment particles.

In some further examples, the media substrate can be a synthetic media substrate, or a substrate that includes synthetic materials. For example, in some cases, the media substrate can be a polyolefin media substrate, a vinyl media substrate, a styrene media substrate, a polycarbonate media substrate, a polyamide media substrate, an epoxy media substrate, or the like. It is noted that these synthetic media substrates need not be made entirely of a synthetic material, but may include the synthetic material as a coating or the synthetic material can be integrated into a more traditional paper media. However, in some examples, the media substrate can be made entirely of the synthetic material, or a combination of different synthetic materials, such as those listed above.

It is noted that, as used in this specification and the appended claims, the singular forms "a," "an," and "the" include plural referents unless the content clearly dictates otherwise.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

In this disclosure, "comprises," "comprising," "having," "includes," "including," and the like, and are generally interpreted to be open ended terms. The term "consisting of" is a closed term, and includes only the methods, compositions, components, steps, or the like specifically listed. "Consisting essentially of" or "consists essentially" or the like, when applied to methods, compositions, components, steps, or the like encompassed by the present disclosure, refers to elements like those disclosed herein, but which may contain additional composition components, method steps, etc., that do not materially affect the basic and novel characteristic(s) of the compositions, methods, etc., compared to those of the corresponding compositions, methods, etc., disclosed herein. When using an open ended term, like "comprising" or "including," it is understood that direct support should be afforded also to "consisting essentially of" language as well as "consisting of" language as if stated explicitly, and vice versa.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

Percentages, ratios, and parts refer to weight percentages, weight ratios, and parts by weight unless otherwise specified or otherwise clear from the surrounding context.

As a further note, in the present disclosure, it is noted that when discussing the printing systems, methods of forming a printed image, and printed articles, each of these discussions can be considered applicable to each of these examples, whether or not they are explicitly discussed in the context of that example. Thus, for example, in discussing details about the printing system per se, such discussion also refers to the methods and the printed articles described herein, and vice versa.

The following example illustrates aspects of the present technology. However, it is to be understood that this example is only exemplary or illustrative of the application of the principles of the present systems and methods. Numerous modifications and alternative systems, methods, compositions, media, and so on may be used without departing from the spirit and scope of the present disclosure. The appended claims are intended to cover such modifications and arrangements. Thus, while the technology has been described with particularity, the following example provides further detail in connection with the present technology.

Example

Pre-Treatment of Print Media with an Electric Field Generated Between an Electrode and a Conductive Plate An electrode and conductive plate pair were connected in a high voltage circuit and positioned at a distance within 10 mm of one another. The electrode was made of a twisted carbon fiber cord having a plethora of carbon fiber protrusions extending therefrom. The conductive plate was made of an aluminum sheet. A voltage of about 25,000 volts was applied to the electrode using alternating current at a frequency of about 25,000 hertz to generate an electric field between the electrode and the conductive plate.

One half of a synthetic media sheet was exposed to the electric field, while the other half of the synthetic media sheet was not. A variety of text, bar codes, and other images were then printed on each of half of the synthetic media sheet. The half of the sheet that was exposed to the electric field exhibited far superior print and image quality as compared to the half of the synthetic media sheet that was not pretreated. More specifically, the treated area had higher optical density and much less ink coalescence.

While the disclosure has been described with reference to certain examples, various modifications, changes, omissions, and substitutions can be made without departing from the spirit of the disclosure. It is intended, therefore, that the disclosure be limited only by the scope of the following claims.

What is claimed is:

1. A printing system, comprising:

an electrode having a plurality of electrode protrusions associated therewith;

a conductive plate, wherein the electrode and the conductive plate are positioned with respect to one another to generate an electric field therebetween and to allow a media substrate to be positioned therebetween to be exposed to the electric field; and an inkjet print head to form a printed image on the media substrate after exposure to the electric field.

2. The printing system of claim 1, wherein the electrode comprises a material selected from carbon, carbon fiber, graphite, copper, titanium, brass, silver, platinum, palladium, oxides thereof, alloys thereof, or combinations thereof.

3. The printing system of claim 1, wherein the electrode, the conductive plate, or both have a width that is 75% or more as wide as the print media.

4. The printing system of claim 1, wherein the electrode and the conductive plate are positioned at a distance from one another of from 0.5 millimeters (mm) to 20 mm.

5. The printing system of claim 1, wherein the conductive plate has a fixed position and the electrode moves relative to the conductive plate to generate the electric field between the electrode and the conductive plate.

6. The printing system of claim 5, wherein the electrode and the inkjet printhead are attached to a carriage to pass the electrode over a portion of the media substrate to pretreat the media substrate prior to passing the inkjet printhead over the media substrate to form the printed image on the portion of the media substrate.

7. The printing system of claim 1, wherein the electrode has a fixed position and the conductive plate moves relative to the electrode to generate the electric field between the electrode and the conductive plate.

8. The printing system of claim 1, further comprising an ink reservoir in fluid communication with the inkjet print head, the ink reservoir comprising a pigment-based inkjet ink.

9. A method of forming a printed image on a media substrate, comprising:

pre-treating at least a portion of a surface of a media substrate with an electric field generated between an electrode and a conductive plate, said electrode having a plurality of electrode protrusions associated therewith; and jetting an inkjet ink from an inkjet print head onto the media substrate to form a printed image on the portion after pre-treating.

10. The method of claim 9, wherein the electrical field is applied at a voltage of from 3000 volts to 30,000 volts.

11. The method of claim 9, wherein the electric field is generated via alternating current.

12. The method of claim 11, wherein the alternating current has a frequency of from 5000 hertz (Hz) to 30,000 Hz.

13. The method of claim 9, wherein pre-treating is performed for a time period ranging from 0.1 seconds to 60 seconds.

14. A printed article, comprising:

a media substrate having a modified surface formed by exposure to an electric field generated between an electrode and a conductive plate, wherein the media substrate is substantially devoid of printed fixer, and wherein said electrode has a plurality of electrode protrusions associated therewith; and a digitally printed image on the modified surface, including pigment particles in contact with the modified surface of the media substrate.

15. The printed article of claim 14, wherein the media substrate is a polyolefin media substrate, a vinyl media substrate, a styrene media substrate, a polycarbonate media substrate, a polyamide media substrate, an epoxy media substrate, or a coated offset media substrate.

* * * * *